US006092315A

United States Patent [19]

Katauskas

[11] Patent Number: 6,092,315

[45] Date of Patent: Jul. 25, 2000

[54] SNOW REMOVAL APPARATUS

[76] Inventor: Leonard Katauskas, 906 E. White St., Ely, Minn. 55731

[21] Appl. No.: 09/191,613

[22] Filed: Nov. 13, 1998

Related U.S. Application Data

[60] Provisional application No. 60/066,108, Nov. 19, 1997.

[51] Int. Cl.[7] ..... E01H 5/02

[52] U.S. Cl. ..... 37/285; 37/268; 15/236.01

[58] Field of Search ..... 37/285, 268, 266, 37/270, 265, 264; 294/54.5; 16/110 R; 15/236.01, 257.7

[56] References Cited

U.S. PATENT DOCUMENTS

| | | | |
|---|---|---|---|
| 3,218,738 | 11/1965 | Bowerman | 37/268 |
| 3,583,747 | 6/1971 | Lambert | 37/268 |
| 3,727,964 | 4/1973 | Nordvik | 37/268 |
| 3,773,375 | 11/1973 | Nehls | 37/268 |
| 3,988,643 | 12/1969 | Wenzel . | |
| 3,998,486 | 12/1976 | Mittelstadt . | |
| 4,024,654 | 5/1977 | Snyder | 37/268 |
| 4,089,127 | 5/1978 | Maijala | 37/268 |
| 4,185,403 | 1/1980 | Hardgove | 37/268 X |
| 5,083,388 | 1/1992 | Cooley . | |
| 5,465,510 | 11/1995 | Goodnough et al. . | |
| 5,524,369 | 6/1996 | Phillips . | |
| 5,570,524 | 11/1996 | Groat . | |
| 5,676,413 | 10/1997 | Hauck . | |

OTHER PUBLICATIONS

Minnesota Snow Removal Product Company, Product Brochure, Downloaded From http://www.avalanche–snow.com/products/ on Nov. 16, 1998.

*Primary Examiner*—Victor Batson
*Attorney, Agent, or Firm*—Moore and Hansen

[57] ABSTRACT

A snow removal apparatus generally comprises a wheeled head frame coupled to a handle and further having a slide suspended between the wheeled head frame and the handle is herein disclosed. The head frame of the snow removal apparatus comprises a substantially rectangular base plate having side plates extending therefrom so as to support an axle upon which at least one wheel is rotatably mounted. A first end of the slide is secured to the axle of the head frame and the second end of the slide is attached to the handle at a distance from the head frame that is substantially greater than the width of the head frame.

8 Claims, 3 Drawing Sheets

10
20
22
24
26
28
30
32
34
36
40
42
44
46
48
48a
48b

SNOW REMOVAL APPARATUS

This application is based upon U.S. Provisional Application Ser. No. 60/066,108, filed on Nov. 19, 1997.

FIELD OF THE INVENTION

The present invention relates to an apparatus for removing snow from a roof top or other similarly situated surface. More specifically, the present invention is drawn to a snow removal apparatus having a wheeled head frame with a slide for loose snow attached thereto.

BACKGROUND OF THE INVENTION

The accumulation of large amounts of snow and ice upon a rooftop or upon the horizontal surfaces of an aircraft may pose a serious structural threat to the structure which supports a roof and to the airframe of an aircraft. Furthermore, all snow and ice must be removed from an aircraft prior to a flight. It is therefore desirable to periodically remove snow and ice from a roof top or an aircraft to prevent the accumulation of potentially destructive amounts of snow and ice.

One method of removing snow and ice from an inclined surface such as a roof is to provide heating elements in the roof. Such heating elements are quite capable of melting any accumulation of snow or ice that may be deposited upon the exemplary surfaces and are also capable of keeping those same surfaces clear and dry of snow and ice. However, there is a significant energy requirement for operating heating elements over the large surface areas of a rooftop.

Another method for removing snow from surfaces such as an aircraft is to apply a de-icing compound to the snow or ice that has accumulated on the aircraft. A de-icing compound essentially lowers the freezing temperature of the water which makes up the snow and ice which is accumulated on the aircraft, thereby melting the ice and snow. One drawback to using de-icing compounds to remove ice and snow from an aircraft is that de-icing compounds may be very costly. Another drawback to the use of de-icing compounds is that de-icing compounds may not be environmentally friendly.

Yet another means for removing ice and snow from a roof or aircraft is a bladed scraping instrument commonly known as a snow rake. Typically a snow rake is comprised of a blade that is attached in a normal relationship to a handle. The blade of a snow rake is used to scrape snow or ice from the roof or aircraft surface upon which snow and ice has accumulated. Generally, snow rakes are relatively inexpensive. However, a snow rake may severely damage a roof surface or aircraft when the blade is dragged across the surfaces. What is more, the use of snow rakes may be difficult and strenuous as a user must pull snow and ice from a surface upon which it has accumulated by main force.

Therefore, it is the objective of this invention to provide an apparatus for removing snow from a roof top or the horizontal surfaces of an airplane which is inexpensive, easy to use, environmentally friendly, and which will not damage the surface from which snow and/or ice is being removed.

SUMMARY OF THE INVENTION

The snow removal device of the present invention essentially comprises a head frame that is mounted upon a handle and a slide which is suspended between the frame and the handle. The head frame of the snow removal apparatus comprises a substantially rectangular base plate or web which has a first end, a second end, and a middle portion. The base plate is secured to the handle of the snow removal apparatus at its middle portion. Attached to the base plate of the head frame are a pair of side plates. The side plates extend away from the base plates of the head frame so as to be able to support an axle therebetween in parallel relation to the base plate. The axle typically has at least one wheel mounted thereon and also provides a point of attachment for a first end of the slide.

The slide is an elongate sheet of material having its first end secured to the axle of the head structure and its second end secured to the handle. The sheet must have a slick surface which will permit ice and snow to slide thereon, regardless of the temperature. Furthermore, the slide must be fashioned of a material which will retain its flexibility and slick surface regardless of temperature. The second end of the sheet has a stiffener bar attached across the entire width thereof. This stiffener bar acts as a point of connection for a cord which is used to secure the second end of the slide to the handle. It is preferred that the slide be suspended between the handle and the axle of the head frame in a manner that maintains the slide in tension at all times. Therefore, it is preferred to use an elastic cord such as a bungee cord to secure the second end of the slide to the handle.

Use of the snow removal apparatus of the present invention comprises at a minimum the following steps. First, the head frame of the snow removal apparatus is placed on the lowest portion of an inclined surface from which snow and/or ice is to be removed. The head frame is placed on this inclined surface with the wheels in contact with the snow that is to be removed. Next, the head frame is moved up the inclined surface towards the highest portion of the inclined surface such that the head frame of the snow removal apparatus is passed through the snow that is accumulated on the inclined surface. Finally, the head frame of the snow removal apparatus is moved down the inclined surface. In use, the head frame of the snow removal apparatus will cut snow and ice free from the inclined surface upon which it has accumulated. This cut snow and ice is then free to slide down the slide of the snow removal apparatus and off of the inclined surface. Where all of the snow and ice that is cut free from the inclined surface does not slide off of the inclined surface, but rather accumulates near the lowest portion of the inclined surface, the return stroke of the snow removal apparatus will bring the second end of the slide into contact with this accumulated cut snow to sweep it off of the inclined surface.

Generally, the snow removal apparatus is moved in a straight up and down motion across an inclined surface having snow or ice accumulated thereon. However, it is also possible to run the head frame of the snow removal apparatus laterally across an inclined surface having snow or ice accumulated thereon.

In removing snow and ice from a relatively low pitched surface, it is preferred to replace the cord which attaches the second end of the slide to the handle with a long tether which is secured to the second end of the slide but not to the handle of the snow removal apparatus. The user of the snow removal device first places the head frame of the snow removal apparatus near the edge of the surface from which snow and ice is to be removed. The head frame of the snow removal device is then moved through the snow and ice accumulated on the relatively low pitched surface to a somewhat distant portion of the relatively low pitched surface, thereby cutting the snow and ice accumulated on the relatively low pitched surface free from that surface. With the head frame moved to its relatively distant position upon the relatively low pitched surface, the tether which is attached to the second end of the slide is drawn away from the head frame so as to draw the second end of the slide away from the head frame and into the snow and ice accumulated on the relatively low pitched surface. At this point, both the head frame and the slide are moved back towards the user of the snow removal apparatus so as to sweep accumulated snow and ice from the relatively low pitched surface.

DETAILED DESCRIPTION OF THE INVENTION

Figures 1, 2, 3:
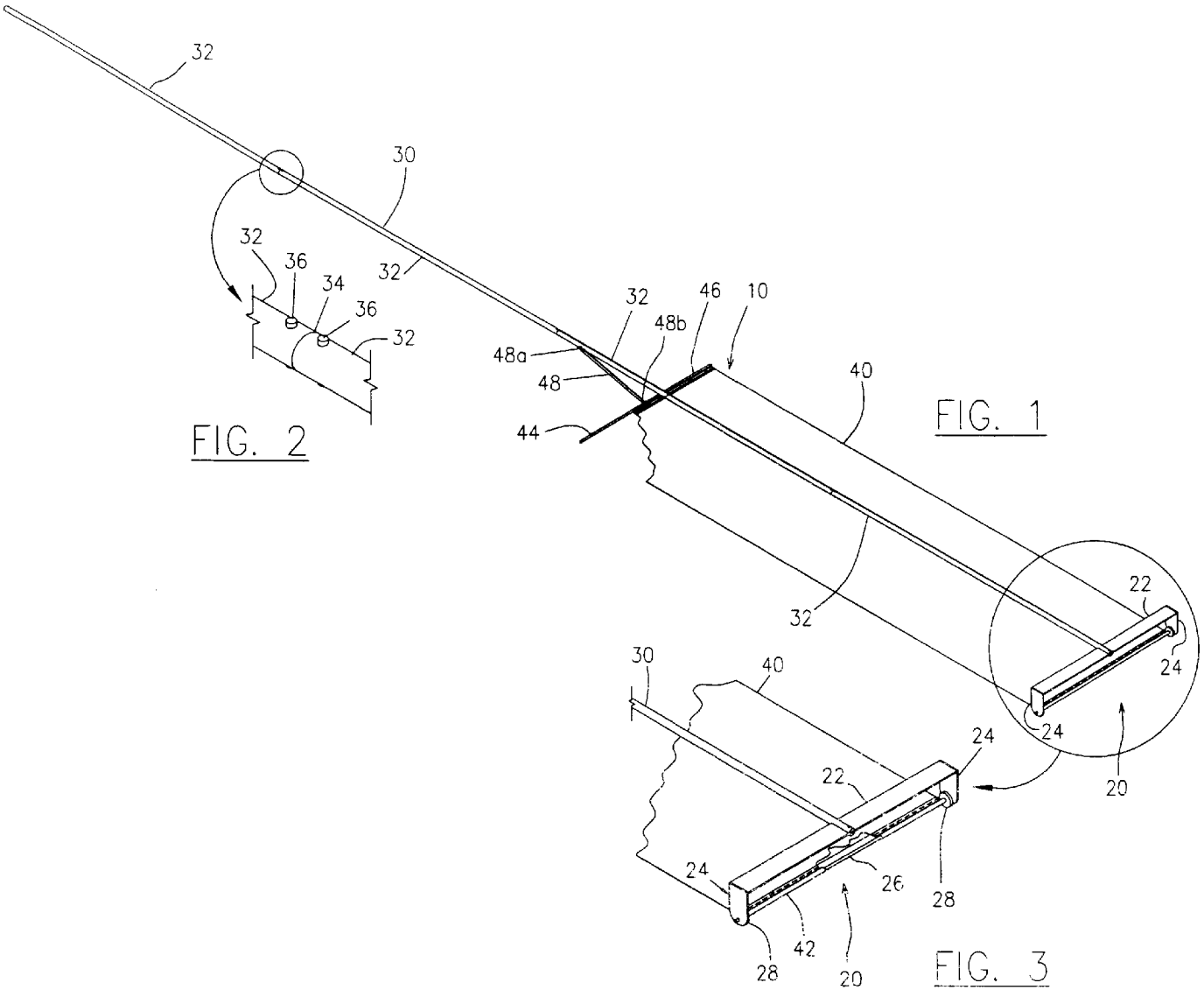
FIG. 1 is a perspective view of the snow removal apparatus of the present invention including a cut-away portion of the slide showing the stiffener bar in more detail.
FIG. 2 is a close up of a joint in the handle of the snow removal apparatus
FIG. 3 is a close up of the head frame of the snow removal device including a cut-away view of a portion of the slide showing the axle in more detail.

Referring first to FIGS. 1–3, it can be seen that a preferred embodiment the snow removal device 10 of the present invention is comprised of a head frame 20 that is mounted upon a handle 30. A slide 40 is secured at a first end to the head frame 20 and at its second end to the handle 30.

The head frame 20 of the snow removal apparatus 10 takes the shape of an upside down "U". The web or base 22 of the head frame 20 is a substantially rectangular plate having side plates 24 depending normally from its respective ends. Side plates 24 are secured to base 22 parallel to one another. Side plates 24 have mounted therebetween an axle 26 which in turn has mounted thereon a pair of wheels 28. Handle 30 of the snow removal apparatus 10 is secured to the head frame 20 at approximately the middle portion, or center, of the base 22. The handle 30 may be secured to the head frame 20 by means of mechanical fasteners, suitable adhesives, and/or by a slot cut into the end of the handle 30.

It is preferred that the base 22 of the head frame 20 be approximately 36 inches wide, with the side plates 24 being approximately 6 inches high. In order to maximize the stability of the head frame 20 of the snow removal apparatus 10, the dimensions of the head frame 20 must maintain a wider-than-higher profile ratio. It is to be understood that the size and configuration of the head frame 20 of the snow removal apparatus 10 of the present invention may be modified without exceeding the scope of this description and the claims appended thereto.

FIG. 3 has a portion of the slide 40 cut away so that axle 26 may be seen. The axle 26 is secured at the lower ends of the side plates 24 such that wheels 28 extend below the lower ends of the side plates 24. The wheels 28 are free to rotate upon the axle 26. It is preferred that there be two wheels 28 mounted on the axle and that these wheels 28 have a thin profile so that they may easily move through snow. In the preferred embodiment of the present invention, the wheels 28 have a diameter of approximately 1½ inches, though it is to be understood that the wheels 28 may be of a larger or smaller diameter depending upon the setting in which the snow removal apparatus 10 is being used. Ultimately, the wheels 28 should be of sufficient diameter so as to allow the axle 26 to clear any obstacles present on a surface upon which snow to be removed has accumulated. Wheels 28 ensure that the snow removal apparatus 10 will not cause damage to the shingles or other materials covering a roof. In addition, where the snow removal apparatus 10 is used to clear snow and ice from an aircraft, the wheels also ensure that the head frame will not damage the surface of the aircraft.

The slide 40 is secured at a first end to the axle 26 of the head fame 20 by means of a first sleeve 42 formed integral to the first end of the slide 40. The axle 26 is received within sleeve 42. The first sleeve 42 is fashioned by folding the first end of the slide 40 back upon itself and securing it in this position as by sewing, though it is to be understood that other methods including adhesives and heat sealing may be used to form the first sleeve 42. The second end of the slide 40 has a stiffener bar 44 which extends across the entire width of the slide 40 through a second sleeve 46 formed integral to the second end of the slide 40 in the same manner as the first sleeve 42 was formed. FIG. 1 has a portion after slide 40 broken away to show the stiffener bar 44 disposed within the second sleeve 46. The second end of the slide 40 is elastically secured to the handle 30 as by a cord 48. It is preferred that the cord 48 be an elastic cord such as a bungee cord. The cord 48 of the preferred embodiment of the present invention has at its respective ends a first S-hook **48*a* and a second S-hook 48*b* which are used to connect the second end of the slide 40 to the handle 30. The first S-hook 48*a* is secured around the stiffener bar 44 at its middle through an aperture formed through the second end of the slide 40 at the second sleeve 46. The second S-hook 48*b* is secured within an aperture formed in the handle 30. The cord 48 is arranged to maintain the slide 40 in constant tension. In the preferred embodiment of the present invention, the slide 40 is approximately 34 inches wide and 10 feet long. However, it is to be understood that the slide 40 may be of different widths and lengths as application and conditions demand. Typically, the slide 40** will maintain a longer-than-wider profile.

The handle 30 is comprised of a plurality of poles 32 which may be releasably secured to one another to form the handle 30. By varying the number and length of the poles 32 which are secured together to form the handle 30, the length of the handle 30 may be varied according to the needs of a user of the snow removal apparatus 10. FIG. 2 illustrates a junction 34 between poles 32. Retention means 36 releasably secure poles 32 to one another and prevent accidental separation of the poles at joint 34 during use of the snow removal apparatus 10. The poles 32 of the handle 30 may be fashioned of aluminum tubing or of a composite material that will provide the requisite stiffness and strength to permit the handle 30 to reach lengths of 40 feet or more. The length of the handle 30 is limited only by the quantity of the snow being removed and the strength and ability of the user of the snow removal device.

In the preferred embodiment of the handle 30, the pole 32 which makes up the end of the handle 30 to which the head frame 20 is secured preferably has a slot cut therein to receive the web 22 of the head frame 20. But because a thin walled tube such as that of the preferred embodiment of the poles 32 would be prone to buckling were a slot to be cut therein, it is preferred to place a solid plug within the end of the pole 32 having the slot to receive the web 22 of the head frame 20 so as prevent the thin walls of the pole 32 from buckling. The plug may be made from polyurethane, aluminum or any other suitable material and will extend to the end of the pole 32 in which it is received. The plug also has a slot for receiving the web 22 of the head frame 20 formed therein in registration with the slot cut into the end of the pole 32. Once the web 22 is received in the slot formed into the pole 32 and the plug received therein, one or more bolts or screws are preferably passed through the tubing of the pole 32 and plug and through the web 22 of the head frame 20 so as to secure the head frame 20 to the handle 30.

The snow removal apparatus 10 of the present invention essentially functions by cutting snow and ice free from the surface upon which it is resting so that it may slide off of the surface upon which it was resting, typically across the slide 40. The slide 40 is fabricated from a thin flexible material having a relatively slick surface so that snow and ice may readily slide there across. It is important to note that the material from which the slide 40 is made must retain its flexibility at extremely low temperatures, preferably to at least −40° Fahrenheit. Likewise, the materials from which the head frame 20 and the handle 30 are made must also maintain their strength at extremely low temperatures.

Figure 5:
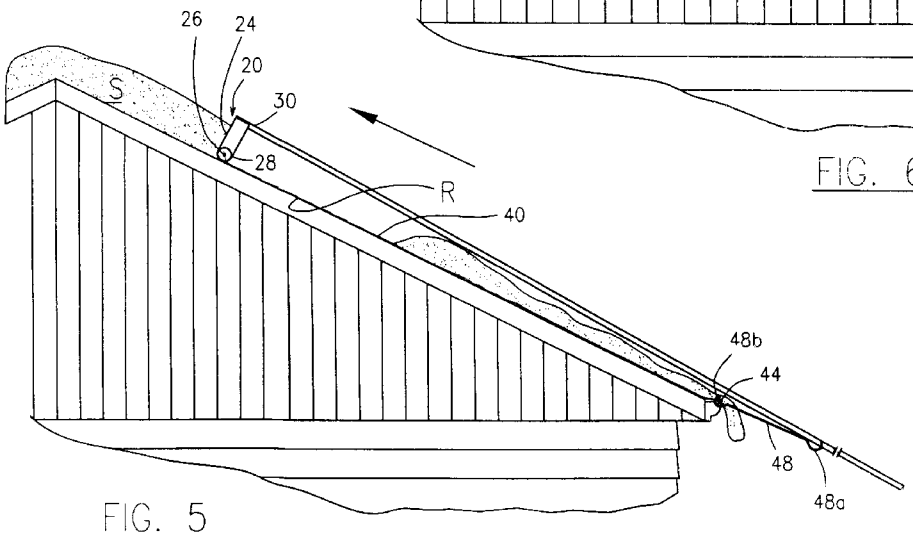
FIG. 5 illustrates the use of the snow removal device of the present invention to remove snow from a roof where the depth of the snow is comparable to the height of the head frame of the snow removal device.

Referring now to FIG. 5, the snow removal apparatus may be seen in use. A user of the snow removal apparatus 10 pushes the head frame 20 upward along a snow-covered surface such as a roof R or an airplane wing, allowing the wheels 28 to roll upon the surface. As the head frame 20 moves upward along the surface, the axle 26 and the side plates 24 cut layers of snow free from the surface upon which the snow has accumulated. Because accumulated snow often melts and refreezes so as to become a relatively uniform solid, it is preferable to cut the accumulated snow along more than one plane. Cutting the accumulated snow along more than one plane promotes the breakup of the uniform mass of snow and facilitates its travel down the slide 40 and off of the surface being cleared.

Figure 6:
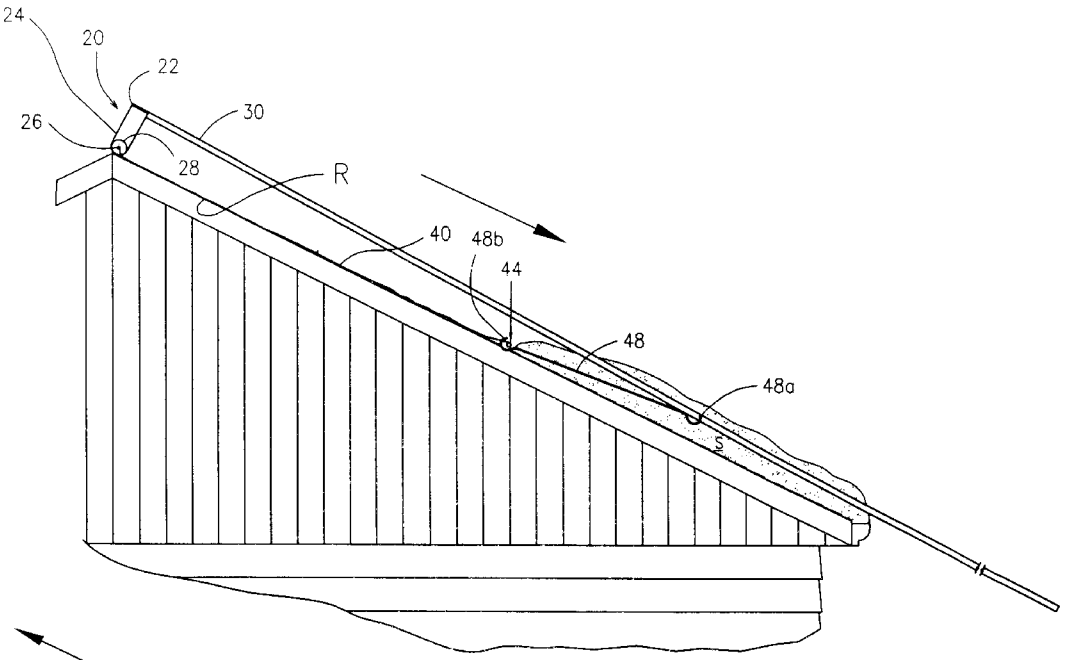
FIG. 6 illustrates a downward or return stroke of the snow removal device to remove any remaining snow or ice which has accumulated near the edge of a roof.

As layers of snow are cut from the surface, gravity will cause them to slide along the slide 40 and off the edge of the surface. Alternatively, the cut layers of snow may also slide off the surface being cleared atop remaining snow. As can be seen in FIGS. 5 and 6, some of the snow that has been cut from the surface may not slide from the surface and may accumulate near the edge of the surface. Typically this occurs when the second end of the slide 40 has been moved above the edge of the surface being cleared. However, when the head frame 20 is moved in a downward direction along the surface being cleared, the second edge of the slide 40 is pulled beneath the snow accumulated near the edge of the surface so as to cut any uncut snow that might remain near the edge and to act as a sweeper for any cut snow which remains at the lowest edge of a surface such as a roof R.

The head frame 20 of the present invention comprises four cutting edges for cutting layers of snow free from a surface upon which they have accumulated: the web 22, the axle 26, and the side plates 24. The second end of the slide 40 at the stiffener bar 44 and each side of the slide 40 also comprise cutting edges capable of cutting accumulated snow free from a surface upon which it has come to rest.

Figure 4:
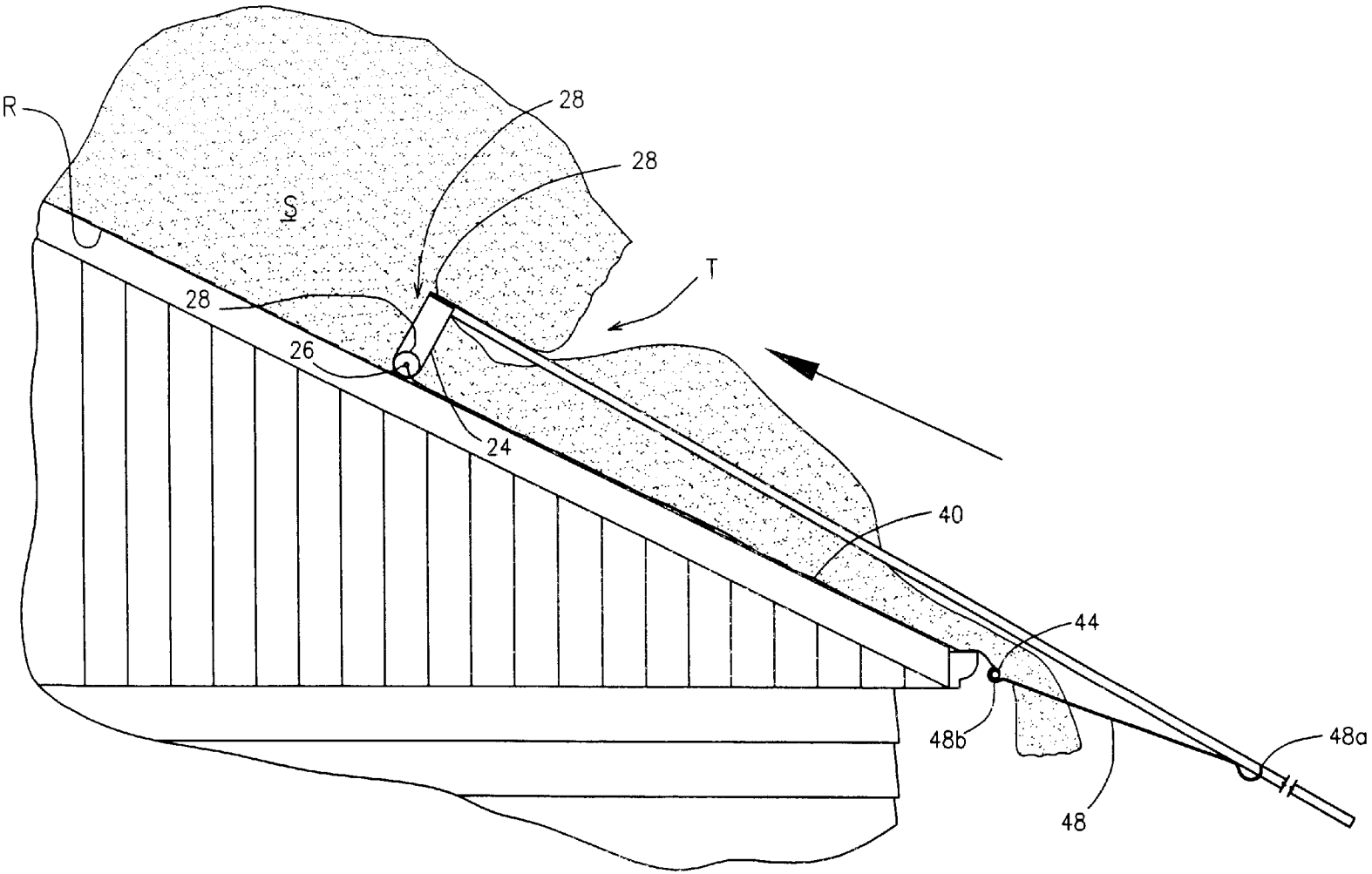
FIG. 4 illustrates the use of the snow removal device of the present invention to remove snow from a roof where the depth of the snow is greater than the height of the head frame of the snow removal device.

FIGS. 5 and 6 depict the use of a snow removal apparatus 10 of the present invention in removing quantities of snow and ice from a roof R wherein the snow has a depth that is the roughly the same height as the side plates 24 of the head frame 20. But where snow accumulated on the surface to be cleared is deeper than the height of the side plates 24, the cutting edges as defined by the web 22, axle 26, and side plates 24 of the head frame 20 will all cut through and undercut the snow, forming a tunnel T as illustrated in FIG. 4. Eventually, as the head frame 20 of the snow removal apparatus 10 is advanced upward along the roof R and snow cut from the tunnel T slides off of the roof R via the slide 40, the top of the tunnel T will collapse of its own weight and fall onto the slide 40 and subsequently slide off roof R. The return or downward stroke of the snow removal apparatus again brings the cutting edge defined by the second edge of the slide 40 into play so as to cut and sweep snow which has accumulated near the edge of a roof R off roof R.

When a user moves the snow removal device 10 laterally across an inclined surface such as a roof R, the edges of the slide 40 will act as cutting edges, cutting the snow from the roof R or other surface so that it may fall to the ground.

Where snow and ice have frozen directly to a roof R or a surface to be cleared, the snow removal apparatus 10 may be turned over and applied to the roof R or surface such that the web or base 22 of the head frame 20 comes into contact with the roof R or surface to be cleared. Drawing the web 22 of the head frame 20 across the layer of ice or snow allows a user to scrape the ice or snow from the surface to be cleared.

In general, the snow removal apparatus 10 of the present invention is most easily utilized on a surface having at least a moderate pitch such as the roof R of a house. However, where a surface to be cleared of snow and ice has a shallow pitch, it is desirable to release the second end of the slide 40 from the handle 30. A long tether (not shown) may then be secured to the second end of the slide 40 at the stiffener in place of the bungee cord. Once a user has completed the upward stroke of the head frame 20 across the surface being cleared so as to cut through the snow accumulated on the surface, the user or an assistant draws the second end of the slide 40 back toward the user or assistant to pull the second edge of the slide 40 beneath the snow that has been cut on the upward stroke of the head frame 20. Drawing the second end of the slide 40 beneath the snow being cleared causes the snow to travel down the slide 40 off roof R. The second end of the slide 40 and the head frame 20 are moved down the roof R on the downward or return stroke of the of the snow removal apparatus 10 so as to sweep snow that has accumulated on the edge of the roof R off roof R.

The use of the snow removal apparatus 10 of the present invention has heretofore been described as being used by a person who is located on the ground. Though this is the preferable method of using the snow removal apparatus 10, it is to be understood that a person using a snow removal apparatus 10 may stand on the surface being cleared as well. In addition, it must be understood that the snow removal apparatus 10 is well suited for use in clearing snow from the wings and control surfaces of airplanes. Where one is using the snow removal apparatus 10 to remove snow from an airplane, that person will typically deploy the snow removal apparatus 10 from an elevated position, e.g. from a scaffold or from a cherry-picker type bucket. Typically, the snow removal apparatus 10 is used to remove the majority of the snow and ice that may have accumulated on the aircraft. The remaining snow and ice is removed using a de-icing compound so that the surface of the air plane is completely free of ice and snow. The use of the snow removal apparatus 10 in conjunction with a de-icing compound dramatically reduces the amounts of de-icing compounds required to remove all of the ice and snow from the aircraft.

This description is intended to provide a specific example of an individual embodiment which clearly discloses the present invention. Accordingly, the invention is not limited to the described embodiment or to the use of the specific elements described therein. All alternative modifications and variations of the present invention which fall within the spirit and broad scope of the appended claims are covered.

What is claimed is:

1. A snow removal apparatus for removing accumulated snow and ice from a surface, said snow removal apparatus comprising:

a head frame comprising at least one cutting edge, said head frame itself comprising:

a base plate having a first end, a second end, and a middle, said base plate being arranged to be secured to a handle at said middle;

a pair of side plates, said side plates being affixed to said first and second ends of said base plate, said side plates being arranged to extend from said base plate in substantially the same direction from said base plate;

an axle, said axle being supported between said pair of side plates in substantial parallel relation to said base plate; and at least one wheel rotatably mounted upon said axle, said wheel being constructed and arranged upon said axle so as to extend beyond a bottom edge of said pair of side plates;

a handle secured at an end to said head frame; and an elongated, flexible slide, said slide being suspended between said head frame and said handle.

2. The snow removal apparatus of claim 1 wherein said handle further comprises:

a plurality of poles, said poles being connectable in series to form said handle, at least one of said poles having formed in one of its ends a structure for connecting said handle to said head frame.

3. The snow removal apparatus of claim 1 wherein said slide further comprises:

an elongate sheet of material having a first end and a second end;

said sheet remaining flexible in temperatures to −40° Fahrenheit;

said first end of said sheet being secured across its entire width to said axle of said head frame;

said second end of said sheet being secured to a stiffener bar across its entire width; and said second end of said sheet being further secured to said handle by a cord attached at a first end of the cord to said handle and attached to said stiffener bar at the cord second end, said cord being arranged such that said sheet is maintained in tension between its first end and second end.

4. The snow removal apparatus of claim 1 wherein the surface is a roof of a building.

5. The snow removal apparatus of claim 1 wherein the surface comprises the wings and control surfaces of an airplane.

6. A method of using a snow removal apparatus to remove snow from a surface, said snow removal apparatus comprising a handle, a head frame comprising a substantially rectangular base plate having a first end, a second end, and a middle, said base plate being arranged to be secured to said handle at said middle, a pair of side plates, said side plates being affixed to said first and second ends of said base plate, said side plates being arranged normal to said base plate, said side plates also extending in parallel fashion in a single direction from said base, an axle, said axle being supported between said pair of side plates in parallel relation to said base plate, and at least one wheel rotatably mounted upon said axle, said wheel being constructed and arranged upon said axle so as to extend beyond a bottom edge of said pair of side plates, and a slide comprising an elongate sheet of material having a first end and a second end, said sheet remaining flexible in temperatures to −40° Fahrenheit, said first end of said sheet being secured across its entire width to said axle of said head frame, said second end of said sheet being secured to a stiffener bar across its entire width, and said second end of said sheet being further secured to said handle by a cord attached at a first end to said handle and attached to said stiffener bar at its second end, said cord being arranged such that said sheet is maintained in tension between its first end and second end, the method comprising the steps of:

placing said head frame on a lowest portion of said surface and in contact with said snow such that said head frame is supported upon said surface upon said wheels;

moving said head frame across said surface toward a highest portion of said surface and through said snow such that said slide is inserted through said snow adjacent said surface;

moving said head frame down said inclined surface so as to cause said second end of said slide to be inserted below snow that has accumulated near the lowest point of said inclined surface.

7. The method of using a snow removal apparatus to remove snow from an inclined surface of claim 6 further comprising the step of moving said head frame laterally across said surface so as to insert an edge of said slide under said snow and adjacent said inclined surface.

8. A method of using a snow removal apparatus to remove snow from a surface, said snow removal apparatus comprising a head frame, a handle having a first end to which said head frame is secured, and a slide, said slide being secured at a first end to said head frame and having a tether secured to a second end thereof, the method comprising the steps of:

placing said head frame on a lowest portion of said surface and in contact with said snow;

moving said head frame up said surface toward a highest portion of said inclined surface and through said snow;

drawing said tether away from said head frame so as to draw said second end of said slide away from said head frame, into said snow, and over an edge of said surface; and moving said head frame down said surface.

* * * * *